US005163301A

United States Patent [19]

Cahill-O'Brien et al.

[11] Patent Number: 5,163,301

[45] Date of Patent: Nov. 17, 1992

[54] LOW CAPACITY CONTROL FOR REFRIGERATED CONTAINER UNIT

[75] Inventors: Barry P. Cahill-O'Brien; Mahendrakumar B. Jain, both of Syracuse, N.Y.

[73] Assignee: Carrier Corporation, Syracuse, N.Y.

[21] Appl. No.: 756,640

[22] Filed: Sep. 9, 1991

[51] Int. Cl.[5] ..... F25B 1/00; F16K 31/02

[52] U.S. Cl. ..... 62/217; 236/78 C; 251/129.04

[58] Field of Search ..... 62/217; 251/129.04; 236/78 C; 318/592

[56] References Cited

U.S. PATENT DOCUMENTS

| | | | |
|---|---|---|---|
| 4,789,025 | 12/1988 | Brandemuchl et al. | 165/130 |
| 4,844,110 | 7/1989 | Paley | 251/129.04 X |
| 4,845,416 | 7/1989 | Scholl et al. | 251/129.04 X |
| 4,875,341 | 10/1989 | Brandemuehl et al. | 62/217 X |

*Primary Examiner*—William E. Wayner

[57] ABSTRACT

A refrigeration system control for a refrigerated container unit in which a compressor suction modulating valve is controlled during light loads near its valve seat by rapidly moving the suction modulating valve to an open position away from the valve seat and then moving the suction modulating valve to the desired position.

6 Claims, 2 Drawing Sheets

LOW CAPACITY CONTROL FOR REFRIGERATED CONTAINER UNIT

BACKGROUND OF THE INVENTION

1. Field of the Invention

This invention relates to a refrigeration control system for a refrigerated container unit and, more particular, to a method and apparatus for controlling the suction modulation valve of the refrigeration system of a refrigerated container unit when the system is operating under light loads with the suction modulation valve positioned near to its valve seat.

2. Prior Art

Many control systems found on refrigeration systems used to cool the interior of refrigerated container units include a processor that is programmed to adjust a suction modulating valve mounted in the compressor suction line of the refrigeration system. The suction modulation valve is adjustable between a fully open and fully closed position. The processor receives supply air temperature information and adjusts the valve setting based upon a preprogrammed schedule in response to the deviation of the sensed supply air temperature from a predetermined set point temperature.

The program used to control the position of the suction modulating valve typically has three terms that are summed to arrive at a desired valve setting. The terms are all based upon the amount of deviation between the sensed supply air temperature and the desired set point temperature. The program not only looks at present conditions, but also at the history leading up to the present condition. The first term in the formulation is a proportional term relating to the present deviation (P), the second term involves an integral term based upon accumulated supply air temperature data (I), and the last term is a derivative term based on changes in supply air deviations (D). This formulation has come to be known in the industry as a PID control program because of the nature of the three terms involved.

Each of the three terms in the PID control formulation is multiplied by a control constant. The constants are selected to maintain the supply air temperature as close as reasonably practical to the set point temperature when the refrigeration unit is operating under steady state conditions. When the supply air temperature deviates some small amount from the set point temperature, the processor sends a signal to the suction control valve in an attempt to adjust the valve to bring the temperature back towards the desired set point. However, when operating a suction modulation controlled refrigeration system under low load conditions, e.g. when the ambient temperature is very low, the suction modulation valve is positioned very close to its seat, i.e. almost closed, and due to refrigerant flow forces operates in an unpredictable manner when control by means of the normal processor control signals.

This unpredictable behavior of the suction modulation valve occurs both when the valve is requested to close near its seat and when it is requested to open a small amount near it seat. When closing near its seat the valve gets stuck, preventing it from closing completely even though the valve is receiving the normal signal from the processor calling for the valve to close, thus the temperature of the supply air continues to decrease and the difference in temperature between the actual container unit and the desired set point continues to increased. This deviation from set point can damage sensitive cargo.

Moreover, when the valve is almost closed near its seat it also gets stuck when requested, by way of the normal open signal from the processor, to open a small amount, thus the temperature of the supply air continues to increase and sensitive cargo may be damaged.

Thus, there is a clear need for a control for a refrigerated container unit having a suction modulation valve that will prevent erratic response of the suction modulation valve when operating near its closed position, or near its seat, that is, within 0–2.5 percent open, to maintain the container temperature at a desired set point. The present control determines when a suction modulation valve is stuck near its seat, and send a signal to the valve which moves the valve rapidly to an open position where it operates predictably, generally to about 30% open, and then moves the valve either rapidly back to the closed position or predictably back to its desired open position.

SUMMARY OF THE INVENTION

It is an object of the present invention to improve the refrigeration controls for a container unit.

It is a further object of the present invention to provide an improved means for controlling the temperature of chilled air delivered to a refrigerated container unit when operating under light load conditions.

It is another object of the present invention to exercise predictable control over a suction modulation valve of a refrigerated container unit when the valve is operating in the region near its valve seat to maintain the air temperature close to a desired set point.

It is yet another object of the present invention to provide a control system for a refrigerated container unit that is capable of holding the temperature of the unit close to a desired set point temperature by running the compressor continuously and operating a suction modulation valve in a predictable manner near its seat to control the temperature.

In accordance with an aspect of the present invention, these and other objects are attained by a method and apparatus for controlling the temperature of the supply air delivered from a refrigeration system to a refrigerated unit fitted with a suction modulating valve in order to hold the supply air temperature close to a desired set point temperature when the system is operating under light loads with the suction modulation valve operating in the region near the valve seat. A processor is arranged to open and close the suction modulating control valve located in the suction line of the refrigeration unit to regulate the capacity of the unit and thus supply air temperature. A sensor in the supply air passage provides temperature data to a comparator that compares the sensed temperature to a desired set point temperature and, in turn, supplies the processor with a signal indicative of the amount of deviation between the supply air temperature and the set point temperature. The processor utilizes a program to determine when the valve is operating in the region near the valve seat and to provide a signal to the valve to rapidly adjust the position of the suction modulating control valve when the valve is operating in the region very close to its seat under light loads. Due to the non-linear response characteristics of the valve when almost closed, the valve exhibits an unpredictable behavior and gets stuck when closing, preventing it from closing completely, and gets stuck when almost closed but is requested to open a small amount, preventing it from opening in small increments. These erratic responses prevent accurate temperature control under light load conditions.

When operating in the region very close to its seat the control will move the valve rapidly to a position or region where the valve exhibits predictable behavior and then the valve is moved back to the desired position requested by the control. This rapid motion is adequate to free the valve from the stuck position, but does not significantly affect the flow of refrigerant which would cause the control temperature to change quickly. Further, by minimizing the amount of valve motion, the wear on the valve is reduced.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of this invention.

BRIEF DESCRIPTION OF THE DRAWINGS

Other objects and advantages of the present invention will be apparent from the following detailed description in conjunction with the accompanying drawings, forming a part of this specification, and in which reference numerals shown in the drawings designate like or corresponding parts throughout the same, and in which.

DETAILED DESCRIPTION OF THE INVENTION

Figure 1:
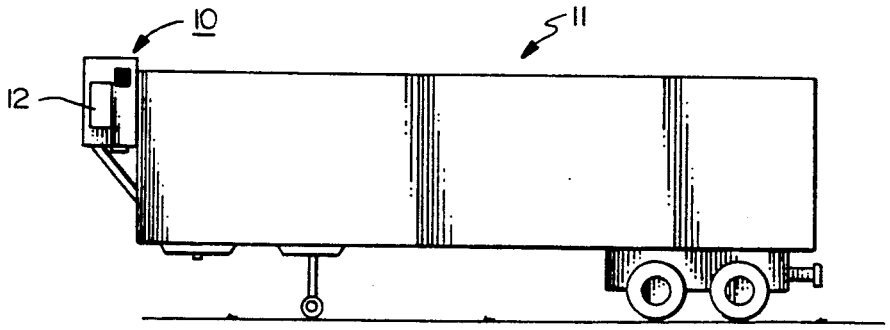
FIG. 1 is a side elevation view of a refrigerated container unit that includes a refrigeration system control embodying the teachings of the present invention.

As illustrated in FIG. 1, the present invention involves a refrigeration unit, generally referenced 10, that is employed to provide conditioned air to a refrigerated container unit 11. The refrigeration unit is generally supplied with electric power from a self contained diesel generator 12 so that conditioned supply air is continually delivered to the refrigerated container unit regardless of its means used to transport the container unit. Accordingly, the container unit can be drawn by a tractor or loaded upon a railroad car or a ship without the danger of the cargo being spoiled. However, the refrigeration unit may be supplied with external electric power, e.g. ship power.

When this type of refrigerated container unit is used to haul certain types of temperature sensitive products, such as bananas, it is highly desirous to hold the container unit temperature as close as possible to a predetermined set point temperature in order to maintain the cargo in a condition that will enhance its market value. Any very small deviation from the set point temperature will seriously degrade the value of the product. Transporters are now seeking refrigerated container units in which the container temperature can be held to about one quarter of a degree centigrade of a desired set point temperature when the refrigerated container unit is lightly loaded, i.e. operating near its desired set point without large deviation.

With existing suction modulating valves, control systems are not capable of accurate control when operating under light load conditions with the valve open less than fifteen percent. Before accurate control temperature can be regained when the suction modulation valve is stuck open, the actual supply air temperature can drift a considerable distance from the desired set point temperature.

Figure 2:
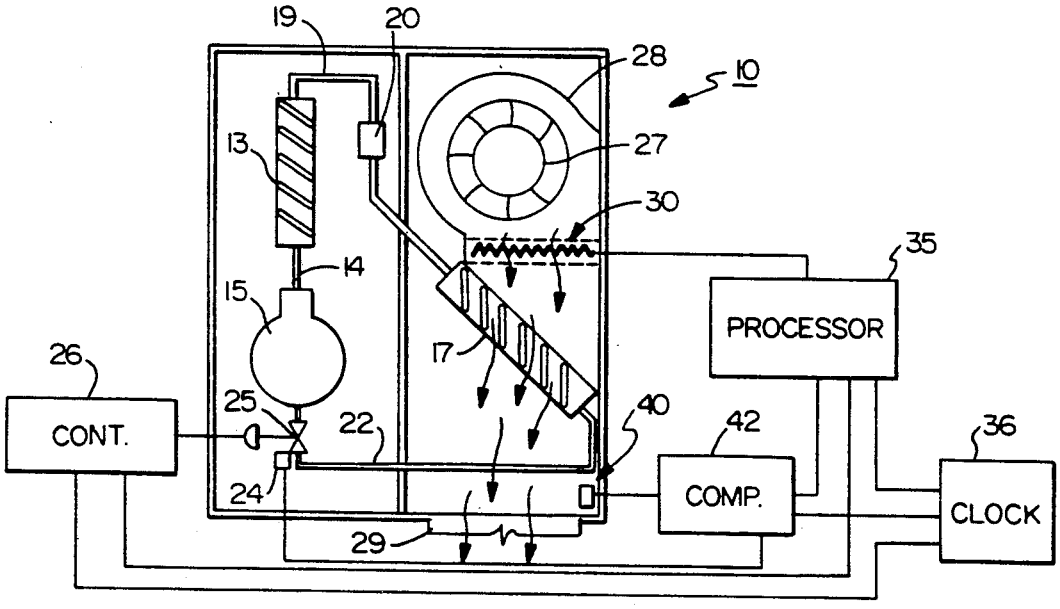
FIG. 2 is a schematic view of the air conditioning unit illustrated in FIG. 1.

Turning now to FIG. 2, thee is illustrated a refrigeration unit 10 that includes a control system for regulating the temperature of the supply air provided to a refrigerated container unit. The refrigeration container unit includes a condenser 13 that is connected on one side to the discharge line 14 of a refrigerant compressor 15 and on the other side to an evaporator 17 by means of liquid line 19. An expansion device 20 is contained in the liquid line which throttles refrigerant as it moves from the condenser to the evaporator. Refrigerant leaving the evaporator is returned to the compressor by means of a suction line 22.

An electric modulating control valve 25 in connected into the suction line of the refrigerating unit. The valve is used to adjust the capacity of the unit and thus control the temperature of the chilled supply air delivered to the container. When the valve is fully opened the unit is operating at a maximum capacity and when it is fully closed the unit is operating at minimum capacity. The control valve is positioned by an electronic controller 26 which is arranged to move the valve in uniform increments between the fully opened and closed positions. The valve is set so that each incremental change in its setting will produce relatively small change in the supply air temperature.

Air is drawn from inside the container by means of a fan means, e.g. and impeller 27 located inside a scroll 28 or a propeller fan. The air is chilled as it is pumped by the fan over the evaporator heat exchanger surfaces and is returned to the container through a supply air duct 29. A trim heater 30 is positioned in the supply air passage between the impeller and the evaporator.

The controller 26 is connected to a processor 35 and to a system clock 36 by suitable electrical lines. A temperature sensor 40 is located at the entrance of the supply air duct 29 and is arranged to sense the temperature of the chilled air that is being returned to the cargo container, and a valve position indicator 24 is located near the valve 25 to sense valve position. The sensor and valve position indicator send supply air temperature data and valve position data to a comparator circuit 42 where it is compared to a desired set point temperature. A signal indicative of the deviation between the supply air temperature and the set point temperature is then forwarded to the processor. A positive going signal indicates that the supply air temperature is higher is lower than the set point temperature. The comparator responds to the system clock to send the deviation signals to the processor at a predetermined intervals.

The processor utilizes a basic PID algorithm to control the position of the control valve in response to the amount of deviation detected between the supply air and set point temperatures.

Figure 3:
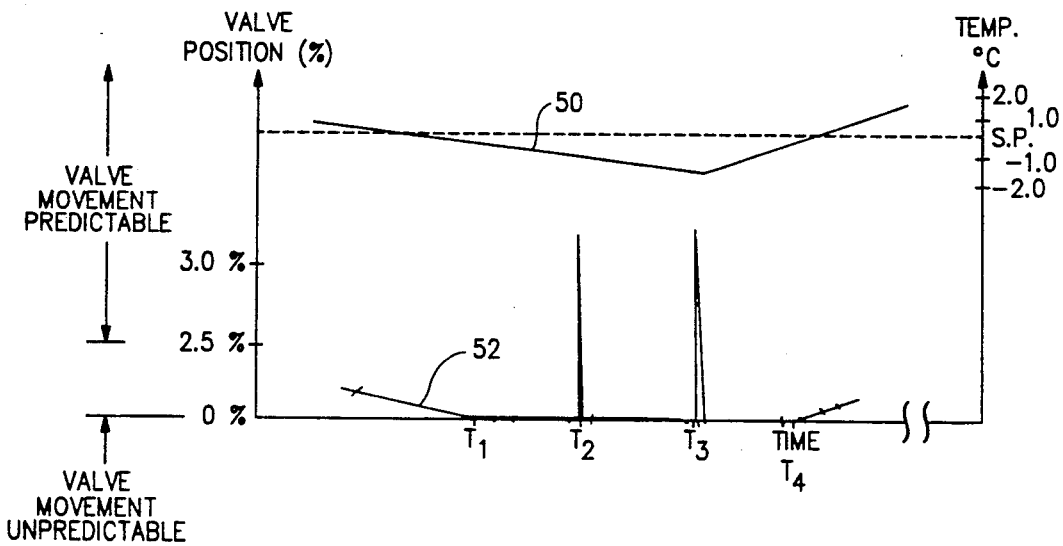
FIG. 3 is a graphic representation relating supply air temperature and suction modulation valve position to time showing the operation of the present control during a request to close the valve when operating in the region very close to its seat.

In FIG. 3 there is shown graphically a curve 50 representing the control temperature of the present system and a curve 52 representing the position of the suction modulating valve 25 of the present system as they relate to a change in time as the valve 25 is modulated closed under light loads. During operation, as the control temperature decreases toward the set point (S.P.) temperature the comparator circuit of the control system sends a signal to the processor of the condition and the processor instructs the controller to move the suction modulating valve to a fully closed position. However, if the valve is stuck slightly open, then the control temperature continues to decrease, and if the control temperature decreases below the set point temperature to a predetermined value, e.g. 1° C., the valve will be rapidly opened and closed, at $T_2$, to help seat the valve. If after a second predetermined period of time, i.e. the time between $T_2$ and $T_3$, the control temperature is still decreasing below the set point, the rapid cycling of the valve is repeated again until the valve actually closes (at $T_3$) and the control temperature returns to the set point (at $T_4$), or until the system terminates modulated valve positioning and shuts off the compressor. The rapid cycling of the valve is repeated after the temperature returns to the set point to ensure that the valve remains closed. The position to which the valve is opened during the rapid movement is greater than 30% to ensure that the valve actually moved, but the duration of the opening is not sufficient to affect the control temperature significantly.

Figure 4:
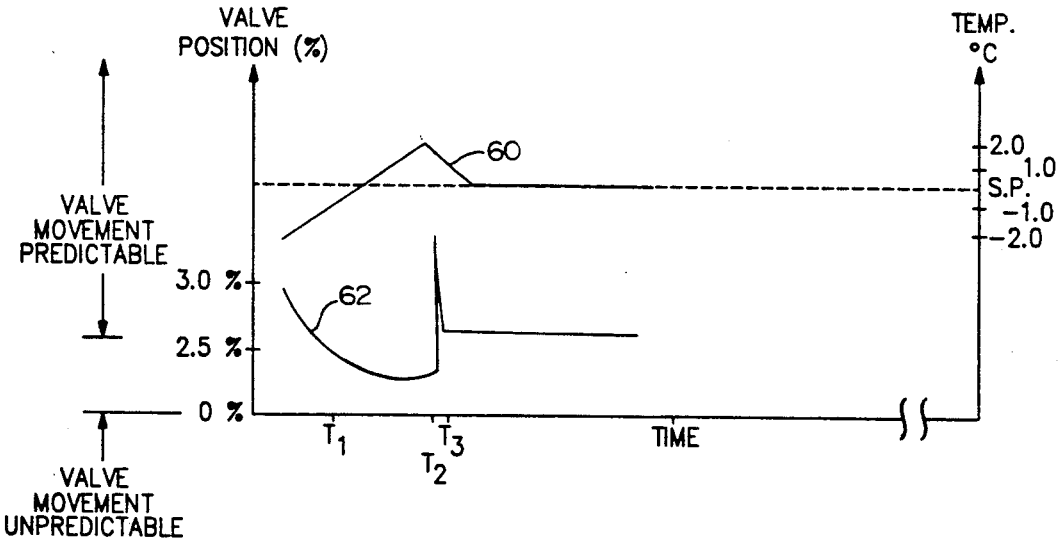
FIG. 4 is a graphic representation relating supply air temperature and suction modulation valve position to time showing the operation of the present control during a request to open the valve when operating in the region very close to the valve seat.

In FIG. 4 there is shown graphically a curve 60 representing the control temperature of the present system and a curve 62 representing the position of the suction modulating valve 25 of the present invention as the relate to a change in time as the valve 25 is requested to modulate open under light loads after it has been positioned within a close distance to its seat. The valve movement has been found to be unpredictable between 0–2½% of full open. During operation, as the control temperature increases toward the set point the comparator circuit sends a signal to the processor which instructs the controller to move the suction modulating valve toward a closed position. However, if the valve is at a position of less than 2¾% open and it is then required to open it operates unpredictably because it is held on the valve seat, and is first rapidly opened, at $T_2$, to greater than 30% open and then closed to the desired position at $T_3$.

While the invention has been described herein with reference to a preferred embodiment, it is to be understood that variations and modifications can be effected by those skilled in the art.

What is claimed is:

1. In a refrigeration system of a refrigerated container unit of the type having a modulating control valve at the suction of a compressor, an improved method of controlling the position of the modulating control valve when the modulating control valve is operating generally in a region near its valve seat to control the temperature inside the refrigerated container unit comprising the steps of:

whereupon receiving a signal, when the temperature inside the refrigerated container unit has deviated from a desired set point temperature, to adjust the modulating control valve to a desired new position, determining the present position of the modulating control valve, if the modulating control valve is in a first region near its valve seat, rapidly opening the modulating control valve to a second region away from its valve seat, and only after the modulated control valve is moved to the second region away from its valve seat, moving the modulated control valve to said desired new position.

2. The method of controlling the position of the modulating control valve as setforth in claim 1 wherein said first region near the valve seat is generally less than two and one half percent of a fully open position of the modulating control valve.

3. The method of controlling the position of the modulating control valve as setforth in claim 2 wherein said second region away from the valve seat to which the modulated control valve is moved is about thirty percent of a fully open position of the modulating control valve.

4. In a refrigeration control system of a refrigerated container unit of the type having a modulating control valve at the suction of a compressor, wherein the operation of the modulating control valve generally in a region near its valve seat will be unpredictable, the improvement comprising;

comparison means for determining when the air temperature inside the refrigerated container unit has deviated from a desired set point temperature and providing an output signal indictive of the deviation;

valve position means for determining the position of the modulating control valve and providing an output signal indictive of the modulating control valve position; and valve control means for moving the modulating control valve, in response to said output signal indictive of a deviation when said output signal indictive of the modulating control valve position indicates the modulating control valve is in a first region near its valve seat, rapidly to a predetermined position away from the valve seat and then moving the modulating control valve to a desired new position to bring the air temperature inside the refrigerated container unit to the desired set point.

5. A control system as setforth in claim 4 wherein said first region near the valve seat is generally less than two and one held percent of the fully open position of the valve.

6. A control system as setforth in claim 5 wherein said predetermined position away from the valve seat is generally about thirty percent of the fully open position of the valve.

* * * * *